US006645015B2

(12) United States Patent
Mase et al.

(10) Patent No.: US 6,645,015 B2
(45) Date of Patent: Nov. 11, 2003

(54) CONNECTOR WITH HOUSING AND RETAINER MOUNTED TO FRONT OF HOUSING

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/173,365

(22) Filed: Jun. 14, 2002

(65) Prior Publication Data

US 2002/0193011 A1 Dec. 19, 2002

(30) Foreign Application Priority Data

Jun. 15, 2001 (JP) ..... 2001-182388

(51) Int. Cl.[7] ..... H01R 13/514; H01R 13/40
(52) U.S. Cl. ..... 439/752; 439/595
(58) Field of Search ..... 439/752, 595

(56) References Cited

U.S. PATENT DOCUMENTS 5,997,364 A * 12/1999 Matsuoka et al. ..... 439/752
6,053,753 A * 4/2000 Kunkle ..... 439/275
2002/0086580 A1 * 7/2002 Kurimoto et al. ..... 439/595
2002/0142655 A1 * 10/2002 Nimura et al. ..... 439/595
2002/0187676 A1 * 12/2002 Kurimoto et al. ..... 439/595

FOREIGN PATENT DOCUMENTS

JP 5-65069 8/1993

* cited by examiner

*Primary Examiner*—Chandrika Prasad
(74) *Attorney, Agent, or Firm*—Gerald E. Hespos; Anthony J. Casella

(57) ABSTRACT

A connector has a housing (10) with cavities (12) and terminal fittings (30) mounted in the cavities (12). The cavities (12) extend to a front mating surface of the housing (10). A retainer (40) is mounted in the housing (10) and has a front wall (42) adjacent the front mating surface of the housing (10). The front wall (42) has tab holes (50) that align with the cavities (12). Loose-movement preventing portions (18, 19) are provided on the housing (10) and/or the front wall (42) of the retainer (40) to ensure alignment of the tab holes (50) and the terminal fittings (30).

11 Claims, 10 Drawing Sheets

CONNECTOR WITH HOUSING AND RETAINER MOUNTED TO FRONT OF HOUSING

BACKGROUND OF THE INVENTION

1. Field of the Invention

The present invention relates to a connector with a retainer for locking terminal fittings.

2. Description of the Related Art

A known connector with a retainer for locking terminal fittings is disclosed in Japanese Unexamined Utility Model Publication No. 5-65069 and also is shown in FIG. 10 herein. The connector of FIG. 10 has a housing 101 with opposite front and rear ends. Terminal fittings 102 are inserted into the housing 101 from the rear and a retainer 103 is mounted on the housing 101 from the front. The retainer 103 has locks 104 that are inserted into the housing 101 after the terminal fittings 102 are inserted. The locks 104 engage the terminal fittings 102 and lock the terminal fittings 102 in the housing 101.

The retainer 103 has a front wall 105 in contact with or near the front end of the housing 101. Tab holes 106 are formed in the front wall 105 at locations that correspond to the terminal fittings 102 in the housing 101. Tabs (not shown) of male terminal fittings of a mating connector (not shown) are inserted into the tab holes 106 for connection with the terminal fittings 102.

The retainer 103 has side walls 107 with resilient locks 108 that engage projections 109 on the housing 101. The resilient locks 107 provide the only engagement between the retainer 103 and the housing 101, and there is no means for positioning the front wall 105 of the retainer 103 with respect to the housing 101. Thus, the front wall 105 may be displaced to bring the tab holes 106 and the terminal fittings 102 out of alignment.

The invention was developed in view of the above problem and an object thereof is to prevent the displacement of tab holes relative to terminal fittings in a housing of a connector.

SUMMARY OF THE INVENTION

The invention is directed to a connector with a housing and at least one terminal fitting inserted into the housing. The connector also has a retainer that locks the terminal fittings in the housing. The retainer has a front wall at front end of the housing. At least one tab hole is formed in the front wall and substantially faces the corresponding terminal fittings in the housing. A loose-movement preventing means prevents the front wall from moving loosely with the respect to the housing in directions substantially parallel with the front wall.

The loose-movement preventing means prevents the front wall of the retainer from moving loosely with respect to the housing. Thus, the tab holes in the front wall are not displaced with respect to the terminal fittings in the housing.

The loose-movement preventing means preferably is formed in the housing to contact an outer peripheral surface of the front wall and preferably is substantially flush with the front surface of the front wall.

Loose movements of the front wall are prevented by the contact of the loose-movement preventing means with the outer peripheral surface of the front wall. Further, the loose-movement preventing means is substantially flush with the mating front surface of the front wall. Thus, there is no possibility that external matter will interfere with a side edge of the front wall in a manner that could move the front wall in the plane of the front wall.

The retainer preferably can be displaced parallel with the front wall between a partial locking position, where insertion of the terminal fittings into the housing is permitted, and a full locking position, where the retainer locks the inserted terminal fittings. The loose-movement preventing means preferably is substantially parallel with displacing directions of the retainer between the partial locking position and the full locking position.

The loose-movement preventing means guides the retainer between the partial and full locking positions. Thus, the retainer can be displaced smoothly from the partial locking position to the full locking position.

The loose movement preventing means preferably substantially covers at least part of the outer peripheral portions of the first wall.

The retainer comprises jig insertion holes aligned respectively with the locks that lock the terminal fittings in the housing. A jig can be inserted into the jig insertion hole to unlock the terminal fittings therein.

The first wall may comprise a projection in a position corresponding to a lateral jig insertion hole or a notch in the housing.

According to a further embodiment, the loose movement restricting means comprises at least one loose movement restricting rib on one of the retainer and the housing and a loose movement preventing groove on the other of the retainer and the housing. The loose movement restricting rib can be inserted into the loose movement preventing groove for avoiding a loose movement of the retainer.

The loose-movement preventing means may further comprise a loose-movement preventing portion on a side edge of the mating end surface of the housing substantially facing the leading edge of the first wall of the retainer.

The retainer preferably comprises a lateral wall that is substantially continuous with and at an angle to the first wall.

The retainer preferably comprises an engaging portion for contacting at least one lock in the housing for locking the corresponding terminal fittings therein and for avoiding deformation of the locks in an unlocking direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE RELATED ART

Figure 2:
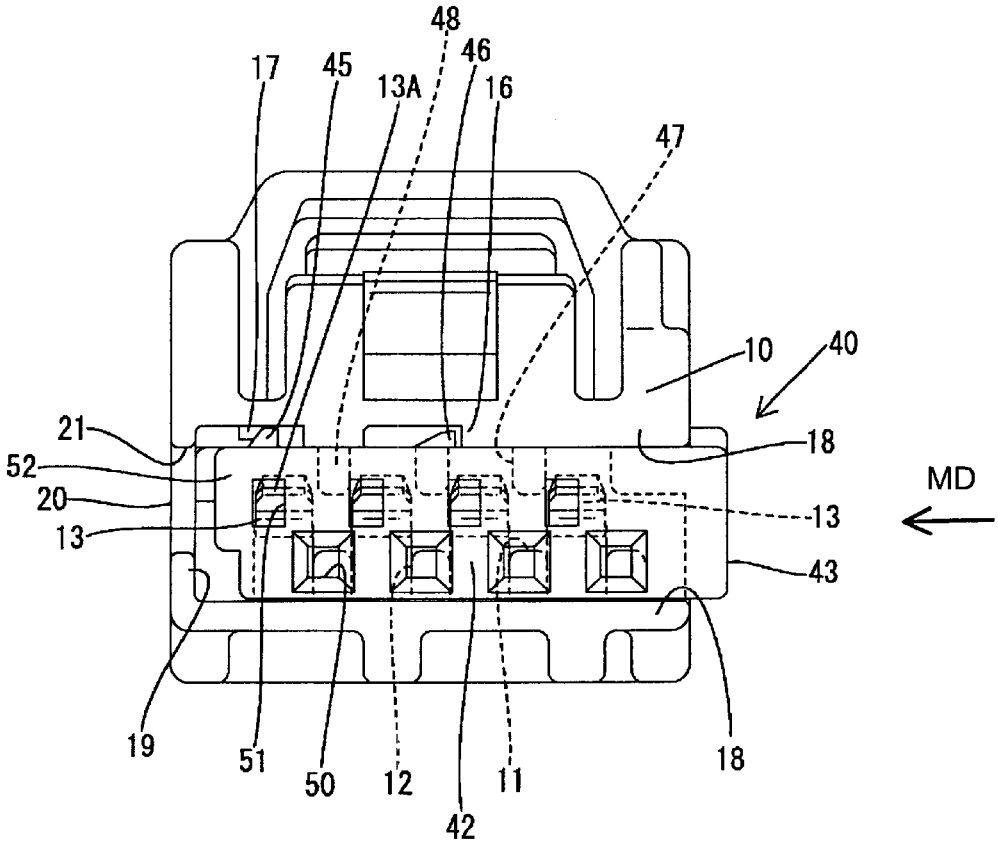
FIG. 2 is a front view showing a state where the retainer is mounted at a partial locking position in the housing.
Figure 3:
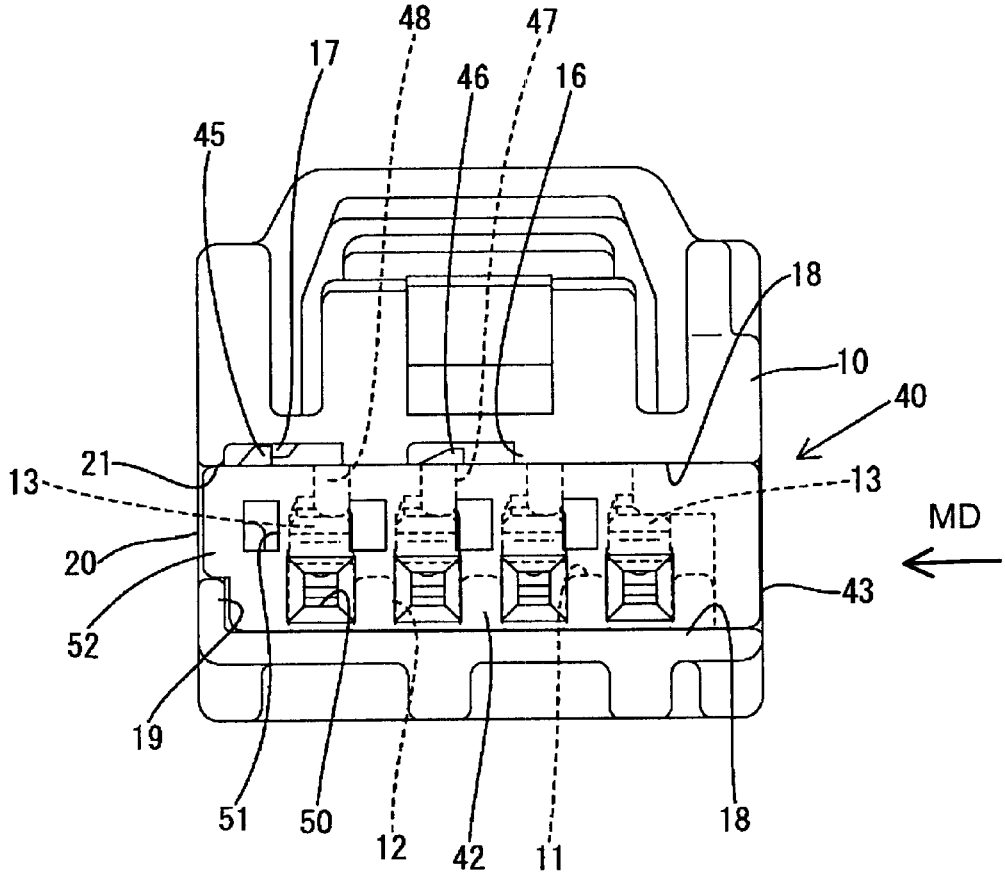
FIG. 3 is a front view showing a state where the retainer is mounted at a full locking position in the housing.
Figure 4:
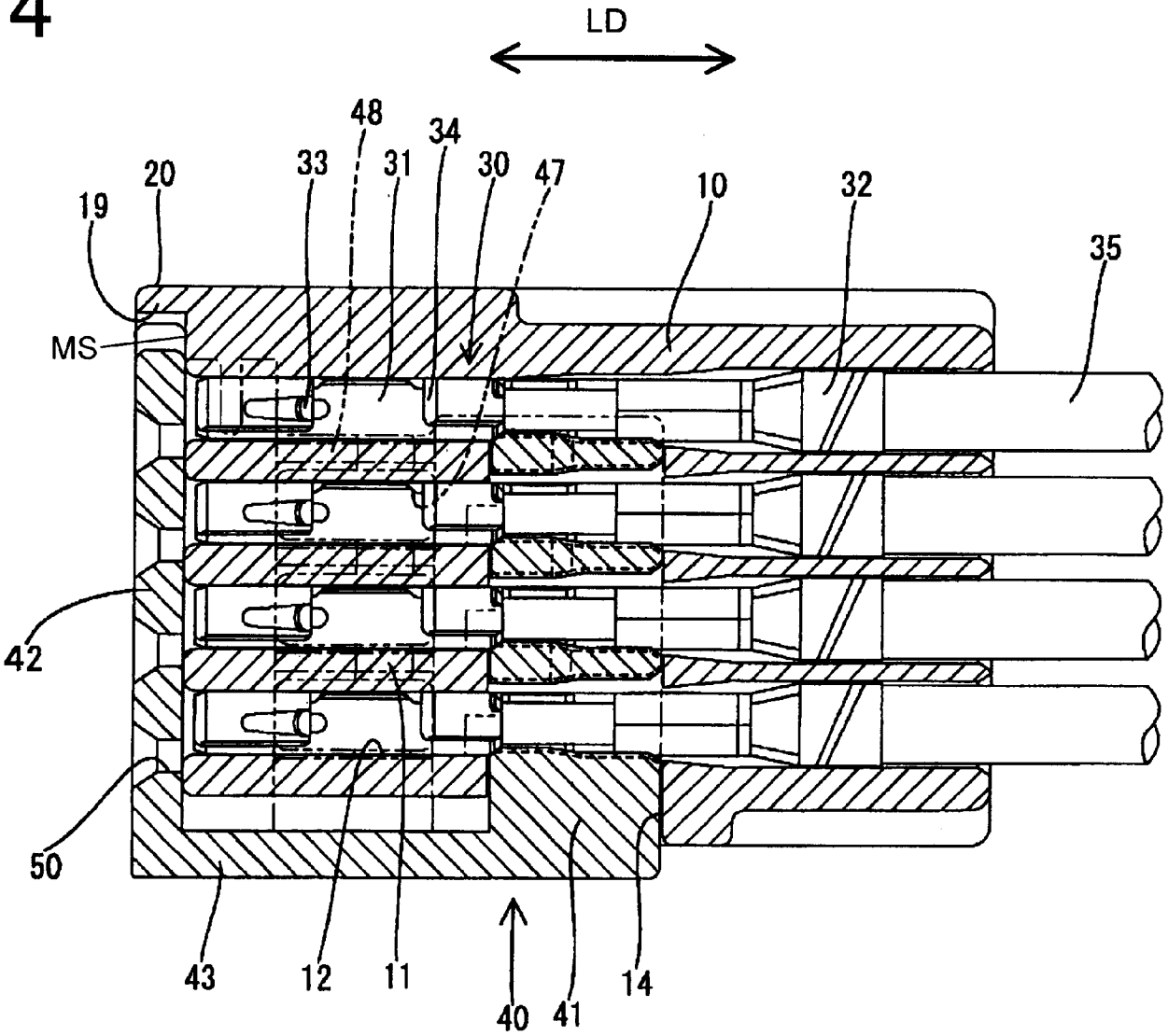
FIG. 4 is a horizontal section showing the state where the retainer is mounted at the partial locking position in the housing.
Figure 5:
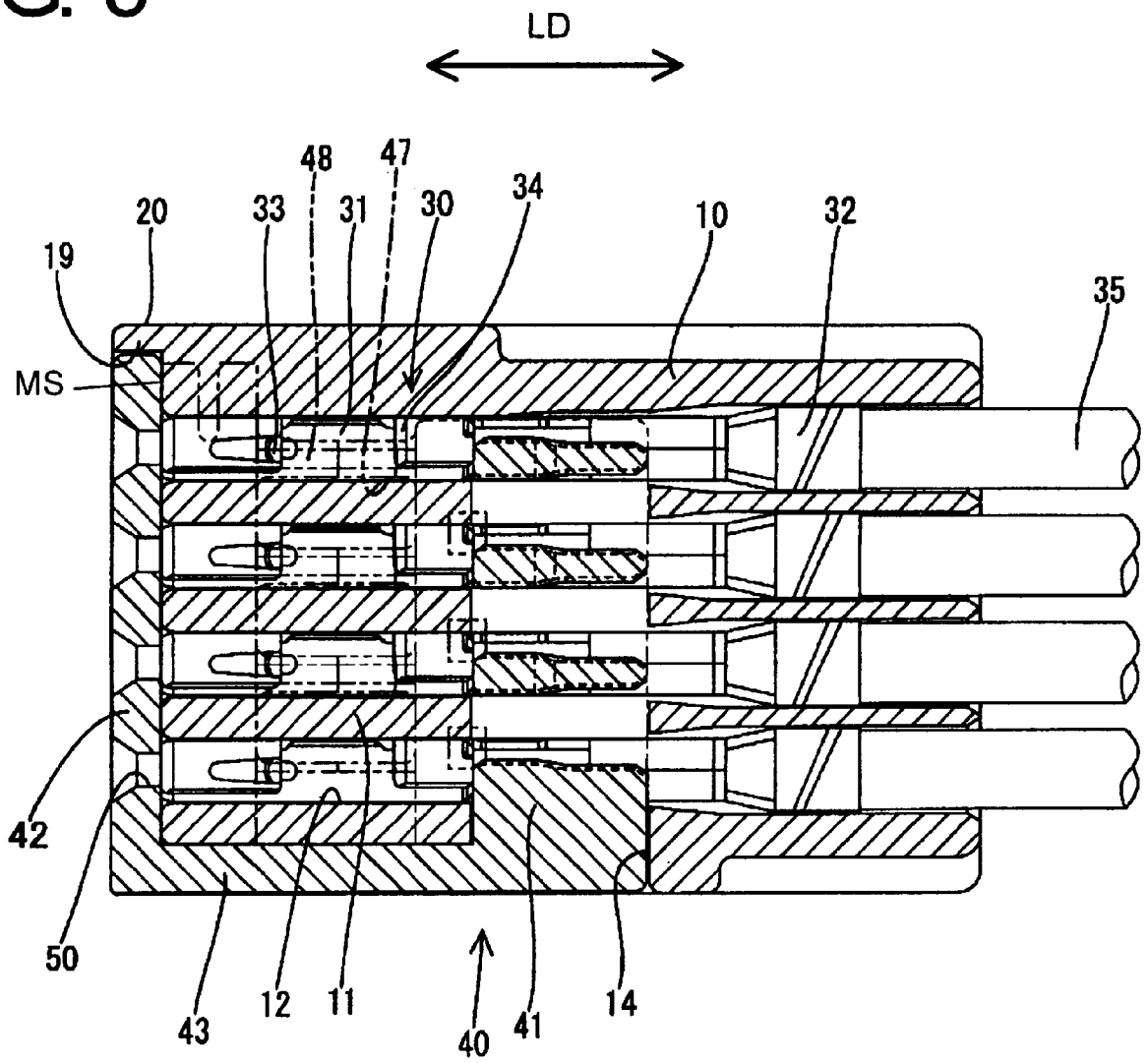
FIG. 5 is a horizontal section showing the state where the retainer is mounted at the full locking position in the housing.
Figure 6:
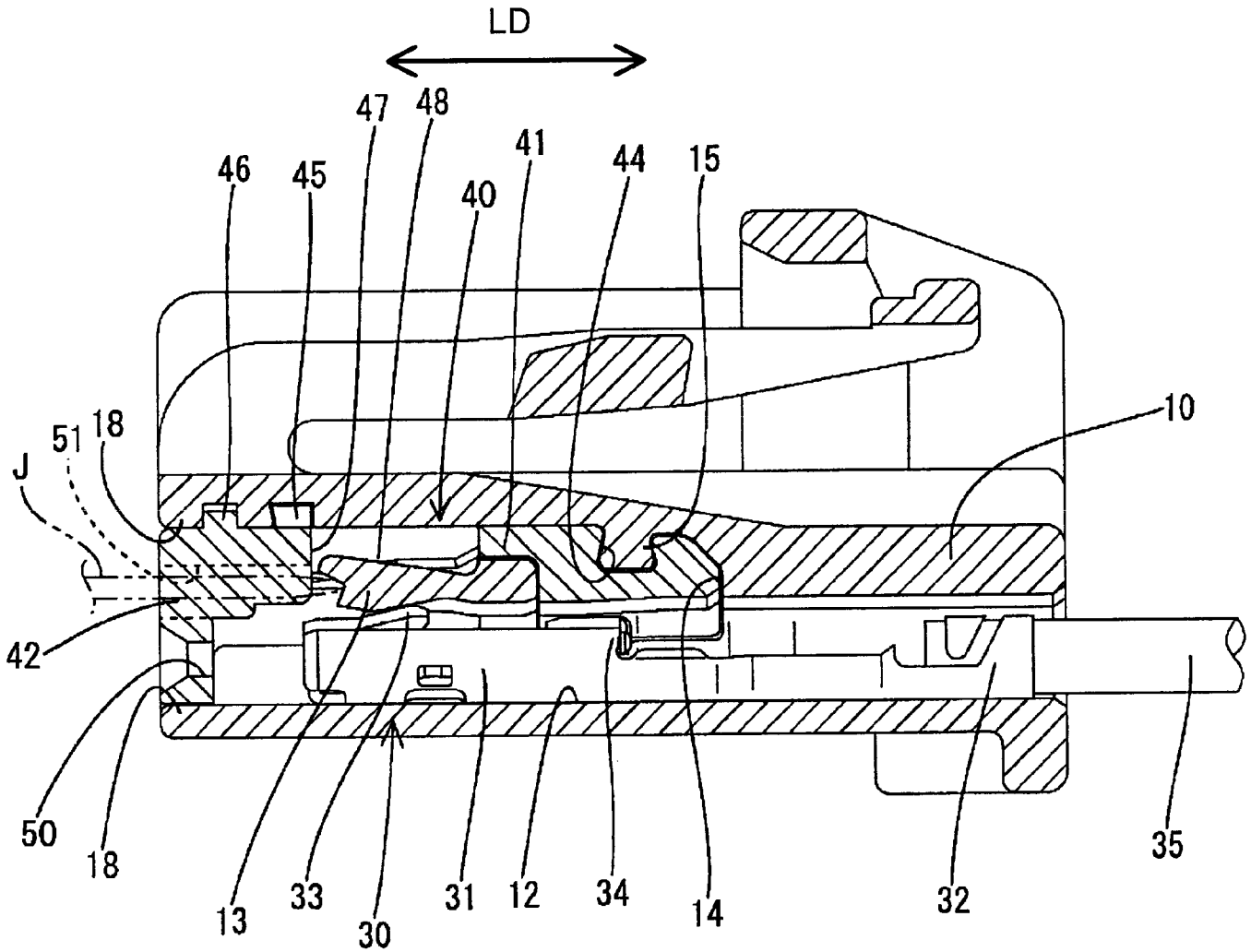
FIG. 6 is a vertical section showing an intermediate stage of insertion of a terminal fitting into the housing.
Figure 7:
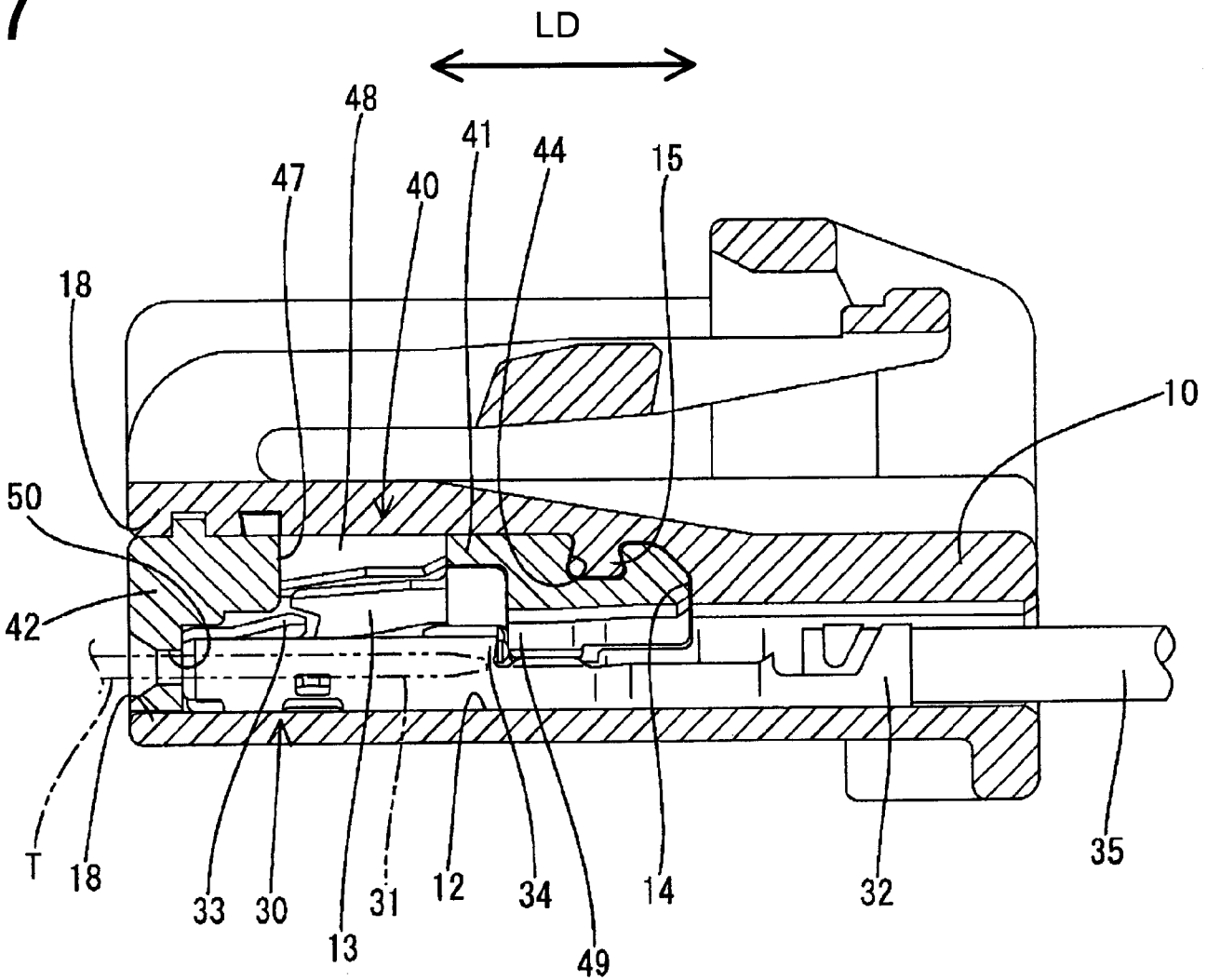
FIG. 7 is a vertical section showing a state where the terminal fitting is properly inserted in the housing.
Figure 8:
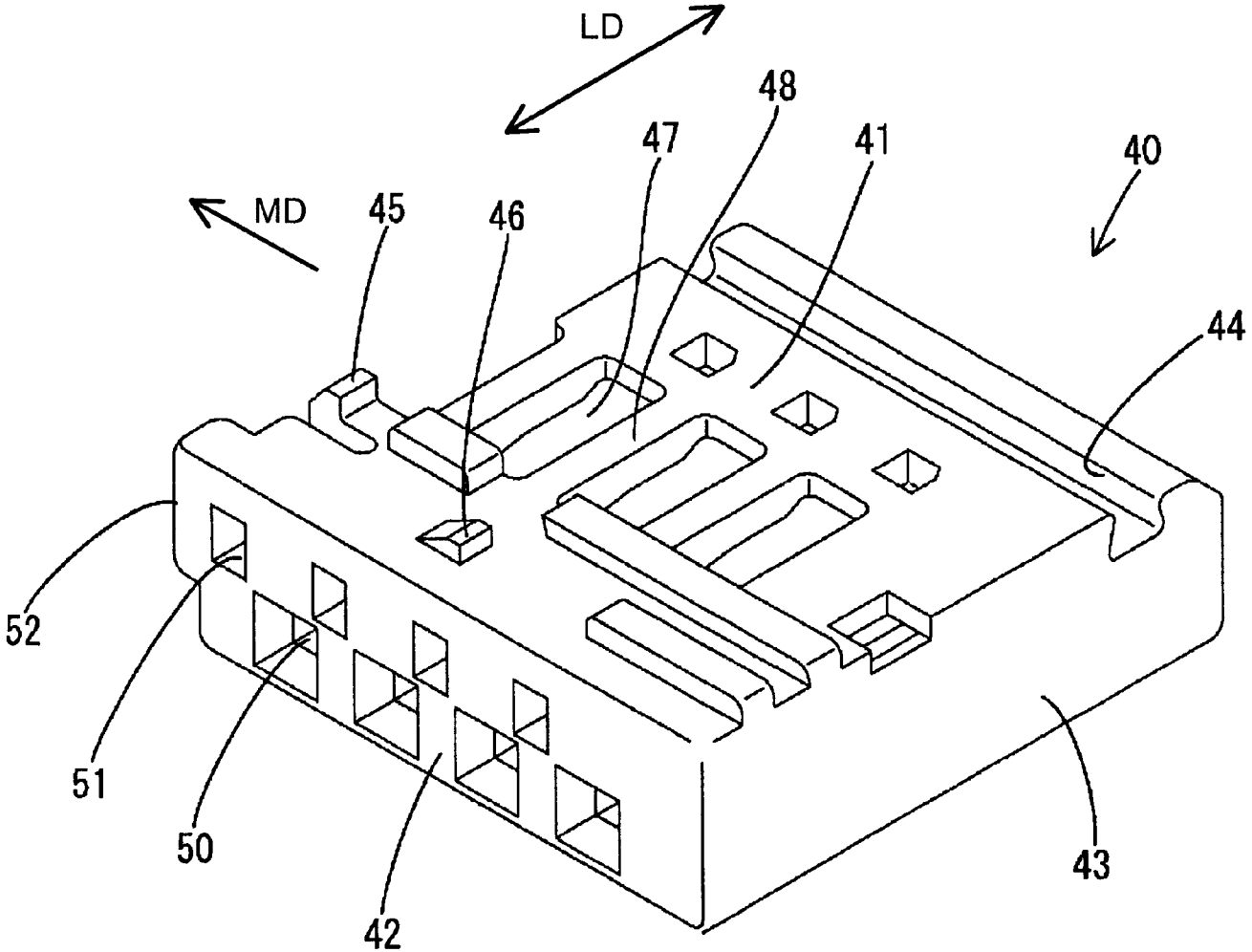
FIG. 8 is a perspective view of the retainer.

A connector in accordance with a first embodiment of the invention is illustrated in FIGS. 1–8 and comprises a housing 10 made e.g. of a synthetic resin, terminal fittings 30 and a retainer 40. In the following description, the left side in FIGS. 4 to 7 is configured for mating with a mating connector (not shown) and is referred to as the front side. The bottom side in FIGS. 4 and 5 is referred to as the left side (reversed in front views of FIGS. 1 to 3), and reference is made to FIGS. 1 to 3, 6 and 7 concerning the vertical direction.

The housing 10 has a plurality of partition walls 11 that are disposed to define a plurality of side-by-side cavities 12. A lock 13 is cantilevered forwardly from each cavity 12 and a retainer accommodating space 14 is disposed above and communicates with the cavities 12. The retainer accommodating space 14 is open in the left and front surfaces of the housing 10. A transverse guide rib 15 is formed near the rear end of the ceiling of the retainer accommodating space 14, and a locking step 16 and a locking projection 17 are formed at a front end position of the ceiling surface.

The opening edge of the retainer accommodating space 14 in the front mating surface MS of the housing 10 is substantially rectangular when viewed from the front. Upper and bottom sides of the opening edge define forwardly projecting loose-movement preventing portions 18. The loose-movement preventing portions 18 extend substantially parallel to a mounting direction MD of the retainer 40 into the housing 10, and substantially parallel to a moving direction MD of the retainer 40 between a partial and full locking position substantially parallel to each other. Conversely, the loose movement preventing portions 18 are substantially normal to the cavities 12. The bottom surface of the upper loose-movement preventing portion 18 contacts the upper surface of a front wall 42 of the retainer 40 from above, whereas the upper surface of the lower loose-movement preventing portion 18 contacts the bottom surface of the front wall 42 from below. The front end surfaces of the two loose-movement preventing portions 18 are substantially flush with the front surface of the front wall 42.

A vertical loose-movement preventing portion 19 projects forward at the right side 20 of the front surface MS of the housing 10, and has a front surface that is substantially flush with the front surface of the front wall 42. Additionally, the loose-movement preventing portion 19 extends substantially vertically up for a dimension of about ⅓ of the entire height of the right edge 20. Thus, a notch 21 is open in the right side 20 of the housing 10 and communicates with the retainer accommodating space 14. The notch 21 has a vertical dimension of about ⅔ of the entire height of the right edge 20.

Each terminal fitting 30 is narrow and long in the longitudinal direction LD and has opposite front and rear ends. A substantially rectangular tube 31 is formed at the front end of the terminal fitting 30 and a wire connecting portion 32 is formed at the rear end. The rectangular tube 31 is open to the front and a resilient contact piece (not shown) is provided in the rectangular tube 31 for connection with a tab T of a male terminal fitting of a mating connector (not shown). A first engaging portion 33 is formed at the upper wall of the rectangular tube 31 and is engageable with the lock 13. The rear edge of the upper wall of the rectangular tube 31 defines a second engaging portion 34 engageable with the retainer 40. The wire connecting portion 32 can be crimped into connection with a wire 35.

The retainer 40 is made e.g. of a synthetic resin and has a main body 41 that can be fit into the retainer accommodating space 14. A substantially rectangular front wall 42 extends downward from the front edge of the main body 41, and a side wall 43 extends down from the left edge of the main body 41. The retainer 40 fits into the retainer accommodating space 14 from the left side of the housing 10 and is transversely displaceable between a partial locking position and a full locking position along the moving direction MD. The upper surface of the main body 41 of the retainer 40 has a guide groove 44 that engages the guide rib 15 of the housing 10 to guide the retainer 40 along the moving direction MD and to prevent loose movement along the longitudinal direction LD. The main body 41 has a first lock 45 at the front end of the upper surface and a second lock 46 substantially in the middle of the upper surface. The first and second locks 45 and 46 engage the left surface of the lock 17 of the housing 10 and the locking step 16 when the retainer is at the partial locking position. As a result, transverse loose movements of the retainer 40 with respect to the housing 10 are prevented. The first lock 45 engages the right surface of the lock 17 and the right edge of the front wall 42 engages the left surface of the loose movement preventing portion 19 when the retainer 40 is at the full locking position to prevent the retainer 40 from making loose movements along the moving direction MD.

The main body 41 has deformation permitting spaces 47 for permitting upward deformations of the locks 13 when the retainer 40 is at the partial locking position. Rib-shaped third engaging portions 48 contact the locks 13 from above when the retainer 40 is at the full locking position. Step-shaped second engaging portions 49 are displaced to the left with respect to insertion paths of the corresponding terminal fittings 30 when the retainer 40 is at the partial locking position and enter the insertion paths of the terminal fittings 30 when the retainer 40 is at the full locking position to engage the second engaging portions 34 from behind.

The upper and lower surfaces of the front wall 42 contact the loose movement preventing portions 18 of the housing 10. The front wall 42 is formed with substantially rectangular tab holes 50 that are displaced laterally from the terminal fittings 30 in the housing 10 when the retainer 40 is at the partial locking position and substantially align with the terminal fittings 30 in the housing 10 when the retainer 40 is at the full locking position. The front wall 42 also has rectangular jig insertion holes 51 that align transversely with the locks 13 when the retainer 40 is at the partial locking position and are displaced to right from the locking portions 13 when the retainer 40 is at the full locking position. The jig insertion holes 51 are higher than the tab holes 50 and correspond to the height of the notch 21 of the housing 10. A projection 52 is formed on the right edge of the front wall 42 and can fit into the notch 21 of the housing 10 when the retainer 40 is at the full locking position. The projection 52 extends continuously from a height above the upper ends of the jig insertion holes 51 to a height below the lower ends of the jig insertion holes 51.

The connector of this embodiment is assembled by first mounting the retainer 40 at the partial locking position with respect to the housing 10 (see FIGS. 2 and 4). In this state, the insertion of the terminal fittings 30 into the cavities 12 is permitted since the second engaging portions 34 of the retainer 40 are displaced to the left from the insertion paths of the terminal fittings 30. Further, the third engaging portions 48 of the retainer 40 are displaced to left from the locks 13 and the deformation permitting spaces 47 are right above the locks 13. Thus, upward resilient deformations of the locks 13 are permitted.

The terminal fittings 30 can be inserted into the cavities 12 in this state. Thus, the upper walls of the rectangular tubes 31 contact the locks 13 and deform the locks 13 upwardly. The terminal fittings 30 reach proper insertion positions where the front ends thereof abut against the rear surface of the front wall 42. Thus, the locks 13 are restored resiliently and engage the first engaging portions 33 from behind. Accordingly the locks 13 prevent the terminal fittings 30 from coming out of the cavities 12.

The retainer 40 then is pushed from the partial locking position to the full locking position (FIG. 3), and the second engaging portions 34 of the retainer 40 engage the second engaging portions 49 of the terminal fittings 30 from behind. Thus, the retainer 40 prevents the terminal fittings 30 from coming out. As the retainer 40 is moved to the full locking position, the third engaging portions 48 of the retainer 40 engage the locks 13 from above. Thus, the retainer 40 prevents upward resilient displacements of the locks 13 so that the locks 13 and the first engaging portions 33 are locked doubly. In this way, the terminal fittings 30 are locked triply and prevented from coming out.

Displacement of the retainer 40 from the partial locking position to the full locking position along the direction MD is substantially parallel with the front wall 42, and the upper and bottom ends of the front wall 42 are in sliding contact with the loose-movement preventing portions 18 during the movement of the retainer 40. Thus, the retainer 40 is guided while having its vertical loose movements prevented.

The tab holes 50 of the front wall 42 and the rectangular tubes 31 of the terminal fittings 30 in the housing 10 are substantially aligned with each other after the retainer 40 is moved to the full locking position. When the connector of this embodiment is connected with the mating connector, the tabs T of the mating connector pass through the tab holes 50 and into the rectangular tubes 31 for connection with the terminal fittings 30. In this state, vertical loose movements of the front wall 42 are prevented by contact of its upper and bottom surfaces with the loose-movement preventing portions 18, and lateral loose movement is prevented by contact of the right end of the front wall 42 with the loose-movement preventing portion 19. Thus, there is no possibility of displacing the tab holes 50 from the rectangular tubes 31 along vertical and lateral directions. Therefore, the tabs T and the terminal fittings 30 can be connected securely with each other.

The front wall 42 of the retainer 40 is exposed at the front surface of the housing 10. However, the upper, bottom and right edges of the outer periphery of the front wall 42 are surrounded by the loose-movement preventing portions 18, 19 of the housing 10. Hence, there is no possibility of permitting an oblique interference of external matter with the upper, bottom and right edges from behind to enter the external matter into a clearance between the front wall 42 and the housing 10. This prevents the front wall 42 from being turned up and forward due to the entrance of the external matter into the clearance between the front wall 42 and the housing 10. Further, the left wall 43 of the retainer 40 is continuous with the left edge of the front wall 42, even if external matter interferes with the front wall 42 from the left. Thus, there is no possibility of permitting the external matter to enter the clearance between the front wall 42 and the housing 10.

The terminal fittings 30 can be withdrawn from the housing 10 by first moving the retainer 40 from the full locking position to the partial locking position to align the deformation permitting spaces 47 with the locks 13. Thus, the locks 13 can deform and the second engaging portions 49 are retracted from the movement paths of the terminal fittings 30. Movement of the retainer 40 to the partial locking position also moves the jig insertion holes 51 into alignment with the locks 13. A long narrow jig J can be inserted into the jig insertion hole 51 to engage a front end 13A of the lock 13 from below. The lock 13 then is deformed and disengages from the first engaging portion 33 of the terminal fitting 30. Thereafter, the terminal fitting 30 can be pulled back e.g. by gripping the wire 35 while the lock 13 and the first engaging portion 33 are kept disengaged by the jig J.

The loose-movement preventing portions 18, 19, prevent loose movements of the front wall 42 of the retainer 40 with respect to the housing 10. Thus, the tab holes 50 in the front wall 42 remain aligned with the terminal fittings 30 in the housing 10.

The front surfaces of the loose-movement preventing portions 18, 19 are substantially flush with the front surface of the front wall 42. Hence, there is no possibility of interference of external matter with outer peripheral surfaces of the front wall 42. Thus loose movements of the front wall 42 parallel to its plane due to interference of external matter is prevented.

The loose-movement preventing portions 18 guide the retainer 40 between the partial locking position and the full locking position. Thus, the retainer 40 can be displaced smoothly from the partial locking position to the full locking position.

The loose-movement preventing portions 18, 19 project from the housing 10 and substantially cover the outer peripheral surfaces of the front wall 42 of the retainer 40. Thus, the front wall 42 will not move due to the entrance of the external matter between the front wall 42 and the housing 10.

Figure 1:
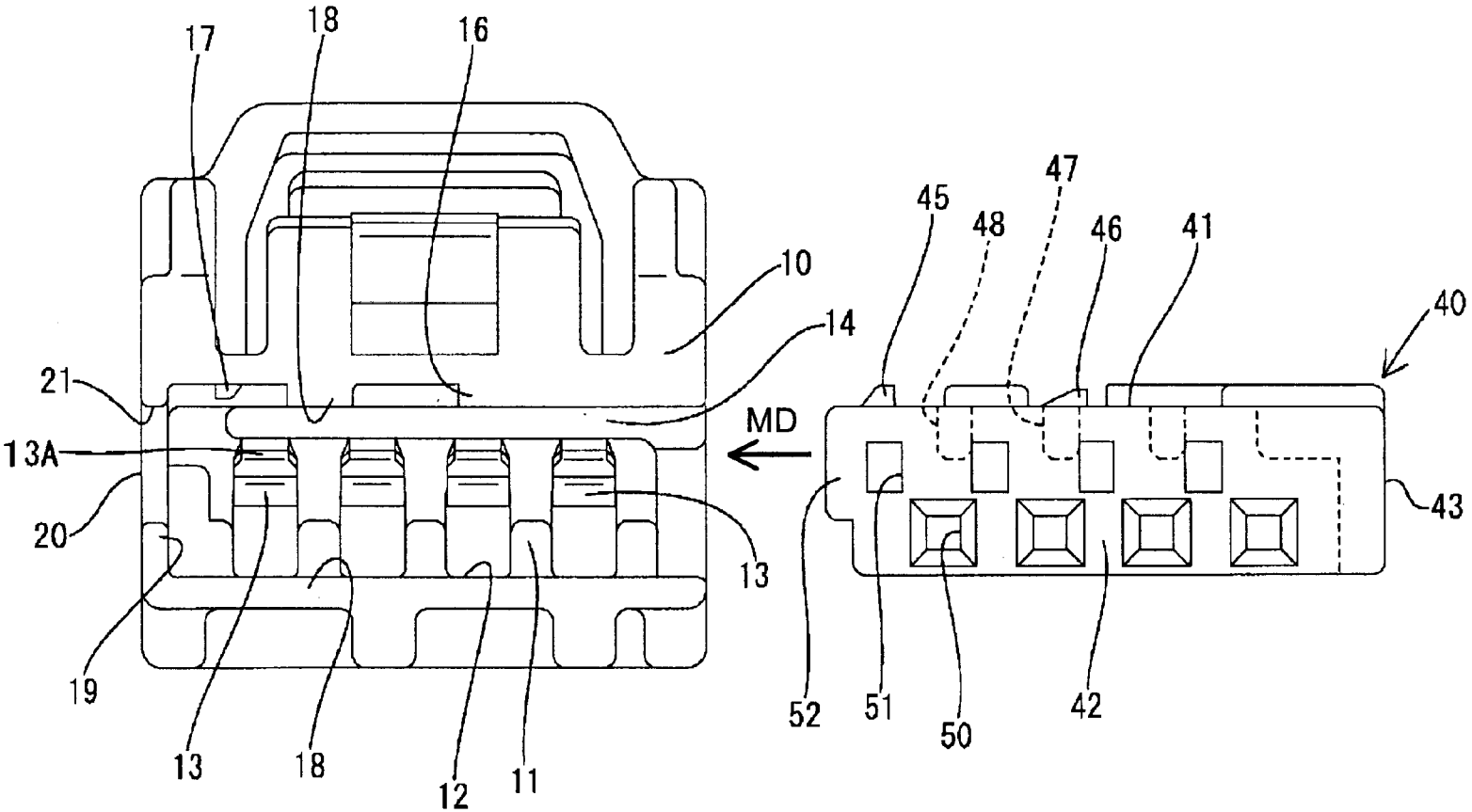
FIG. 1 is a front view showing a state where a retainer is detached from a housing in a first preferred embodiment of the invention.

After the retainer 40 is moved to the full locking position, the leftmost jig insertion hole 51 in FIGS. 1 to 3 is at the right side of the lock 13 that is aligned with this jig insertion hole 51 when the retainer 40 is at the partial locking position, i.e. at a position proximate to the right edge 20 of the front end surface MS of the housing 10. If the loose-movement preventing portion 19 is provided over the entire right edge 20, the right edge of the front wall 42 needs to be cut off accordingly. As a result, a portion to the right of the rightmost jig insertion hole 51 becomes thin and the right side of this opening edge is open in the right edge of the front wall 42. In such a case, the thinned right portion may be broken if the jig J strikes against it. Further, if the right side is open, the jig J inserted into the jig insertion hole 51 may be moved loosely rightward to come off the jig insertion hole 51 and may not be positioned precisely.

On the other hand, the loose-movement preventing portion 19 of this embodiment is on the right edge 20 of the housing 10 facing the right edge of the front wall 42 and is cut off only in the area at the height corresponding to the opening edges of the jig insertion holes 51, and the projection 52 at the right edge of the front wall 42 fits into the notch 21. The projection 52 ensures a sufficient thickness over the entire periphery of the opening edge of the rightmost jig insertion hole 51 to avoid undesired occurrences in which the right side of the opening edge of the jig insertion hole 51 becomes thinner and is open in the right edge of the front wall 42.

Figure 9:
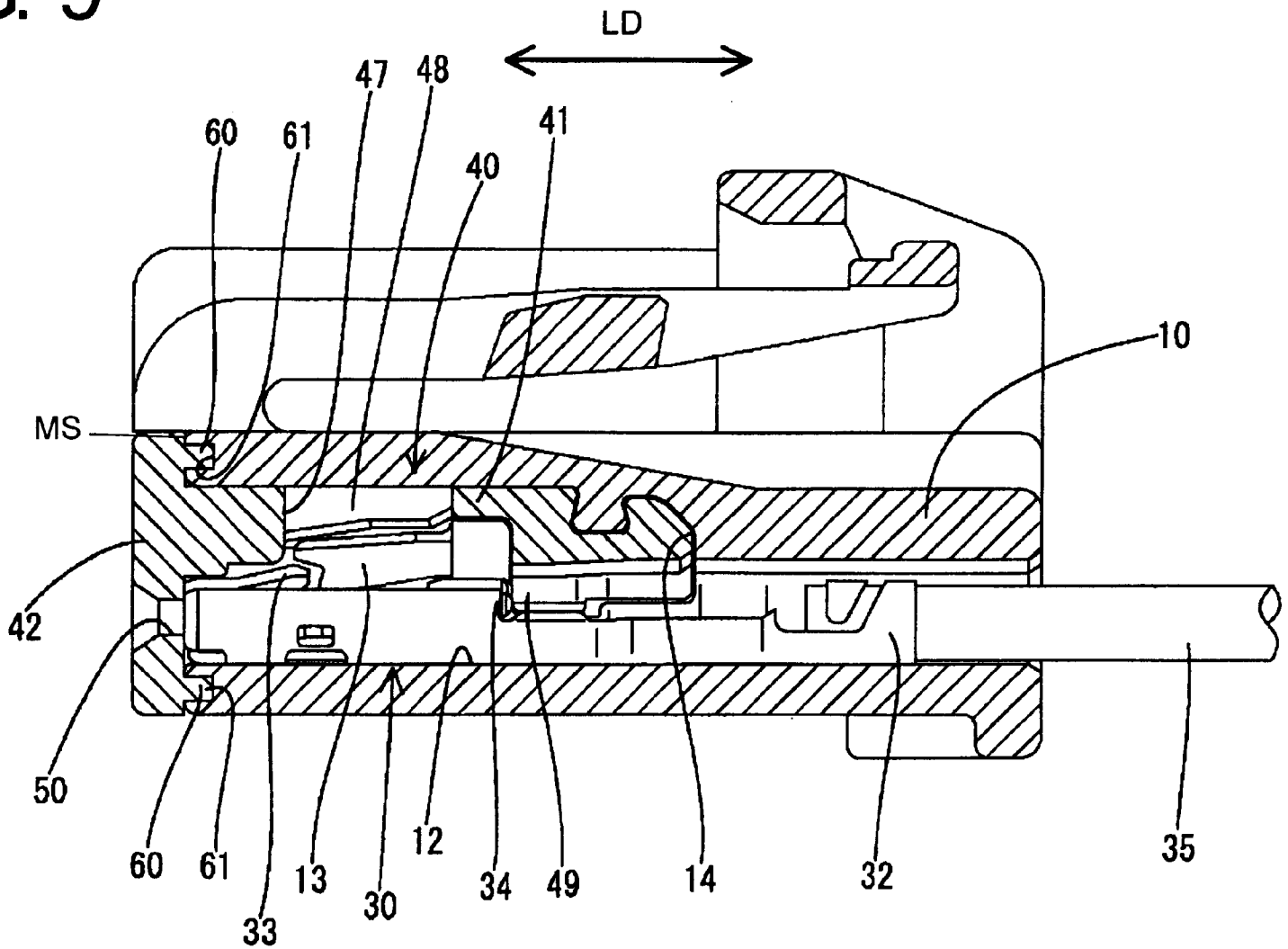
FIG. 9 is a vertical section showing a state where the terminal fitting is properly inserted in the housing in a second embodiment of the invention.
Figure 10:
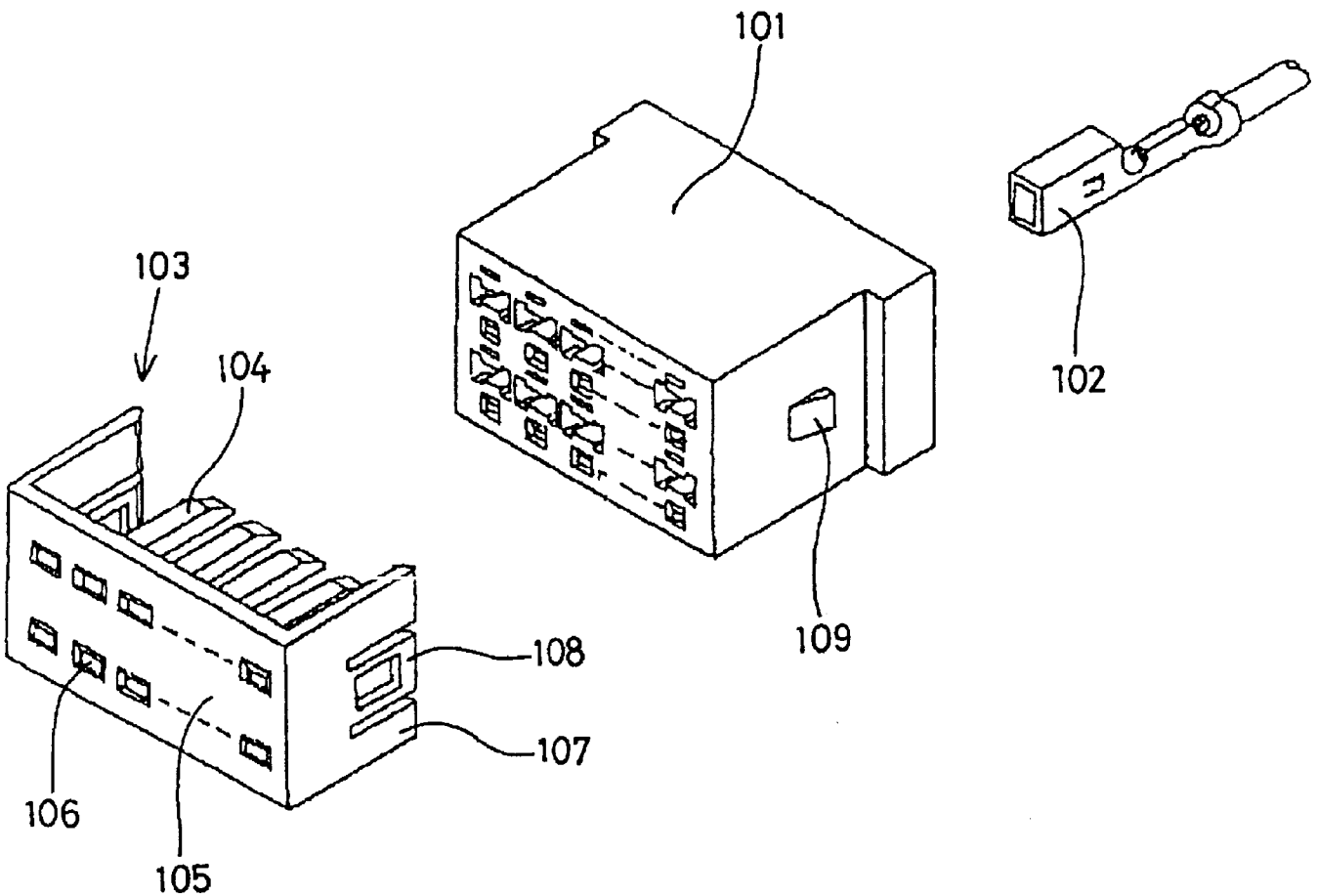
FIG. 10 PRIOR ART
FIG. 10 is an exploded perspective view of a prior art connector.

A second embodiment of the invention is described with reference to FIG. 9 and has a loose-movement preventing means that is different from the first embodiment. Other elements are similar to or the same as in the first embodiment, and similar elements are identified by the same reference numerals, but are not described again.

The loose-movement preventing means of the second embodiment has upper and lower loose-movement preventing ribs 60 on the rear surface of the front wall 42. Upper and lower loose-movement preventing grooves 61 are formed in the front surface MS of the housing 10. The loose-movement preventing ribs 60 and grooves 61 extend parallel with the moving directions MD of the retainer 40 between the partial locking position and the full locking position. Vertical loose movements of the retainer 40 with respect to the housing 10 are prevented by the engagement of the loose-movement preventing ribs 60 and the loose-movement preventing grooves 61.

The invention is not limited to the above described and illustrated embodiments. For example, following embodiments are also embraced by the technical scope of the present invention as defined in the claims. Beside the following embodiments, various changes can be made without departing from the scope and spirit of the present invention as defined in the claims.

The retainer is movable between the partial locking position and the full locking position parallel with the front wall in the foregoing embodiments. However, the invention is also applicable to connectors in which the retainer is not displaceable along the transverse direction with respect to the housing.

The terminal fittings inserted into the housing are female terminal fittings in the foregoing embodiments. However, the invention is also applicable to connectors with male terminal fittings. In such a case, tabs of the male terminal fittings project forward through tab holes of a retainer.

The mounting direction MD of the retainer 40 into the housing 10 and the moving direction MD of the retainer 40 between the partial locking position and the full locking position are the same. However, the invention also is applicable to connectors in which the retainer is mounted into the housing in a direction different from a moving direction between the partial locking position and the full locking position (e.g. the mounting is performed from the front while the retainer is moved between the partial locking position and the full locking position in the lateral direction).

What is claimed is:

1. A connector, comprising:

a housing having a front end, a rear end and cavities extending between the front end and the rear end, a retainer accommodating space extending into the housing at a location between the front end and the rear end and communicating with the cavities, a recess extending into the front end of the housing and opening to at least one side of the housing, the front end of the housing further defining a plurality of loose movement preventing walls projecting forward from the recess in the front end of the housing;

a retainer mounted to the housing for movement in a moving direction transverse to the cavities between a partial locking position and a full locking position, the retainer comprising a main body slidably disposed in the retainer accommodating space and a front wall slidably disposed externally of the housing and in the recess in the front end, the front wall of the retainer further having tab holes aligned with the cavities when the retainer is moved to the full locking position; and interengaging grooves and channels formed respectively on opposed surfaces of the front wall of the retainer and on at least one of the loose movement preventing walls at the front end of the housing, the interengaging grooves and channels being aligned parallel to the moving direction of the retainer for preventing loose movement of the retainer.

2. The connector of claim 1, wherein front ends of the loose-movement preventing walls are substantially flush with a front surface of the front wall of the retainer.

3. The connector of claim 1, wherein the retainer is displaceable substantially in parallel with the front wall between the partial locking position where insertion of the terminal fittings into the housing is permitted and the full locking position where the retainer locks the inserted terminal fittings.

4. The connector of claim 1, wherein the interengaging grooves and channels covers at least part of outer peripheral portions of the front wall of the retainer.

5. The connector of claim 1, wherein the retainer comprises jig insertion holes for inserting a jig into the housing for unlocking the terminal fittings arranged therein.

6. The connector of claim 5, wherein the jig insertion holes are aligned with corresponding locks in the housing for locking the terminal fittings therein when the retainer is in the partial lock position.

7. The connector of claim 6, wherein the front wall comprises a projection in a position corresponding to a lateral jig insertion hole which is fittable into a notch provided in the housing.

8. The connector of claim 1, wherein the loose-movement preventing walls comprises a side loose-movement preventing wall at a side of the housing that substantially faces a leading edge of the front wall of the retainer.

9. The connector of claim 1, wherein the retainer comprises an engaging portion for contacting at least one lock in the housing for locking the corresponding terminal fittings therein so as to avoid the deformation of the locks in an unlocking direction.

10. The connector of claim 1, wherein the retainer is of unitary construction.

11. The connector of claim 10, further comprising a sidewall connecting the front wall and the main body, the sidewall being disposed externally the housing.

* * * * *